US012680694B2

(12) United States Patent
Kim et al.

(10) Patent No.: US 12,680,694 B2
(45) Date of Patent: Jul. 14, 2026

(54) BURNER DEVICE

(71) Applicant: SAMSUNG ELECTRONICS CO., LTD., Suwon-si (KR)

(72) Inventors: Taewoo Kim, Suwon-si (KR); Myoungkeun Kwon, Suwon-si (KR); Byeongkyu Kim, Suwon-si (KR); Qasim Khan, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 719 days.

(21) Appl. No.: 18/106,658

(22) Filed: Feb. 7, 2023

(65) Prior Publication Data

US 2023/0228416 A1 Jul. 20, 2023

Related U.S. Application Data

(63) Continuation of application No. PCT/KR2022/020347, filed on Dec. 14, 2022.

(30) Foreign Application Priority Data

Jan. 19, 2022 (KR) ..... 10-2022-0007935

(51) Int. Cl.
*F23D 14/06* (2006.01)
*F23D 23/00* (2006.01)

(52) U.S. Cl.
CPC ..... *F23D 14/06* (2013.01); *F23D 23/00* (2013.01)

(58) Field of Classification Search
CPC . F23D 2900/14062; F23D 2900/14063; F23D 14/06
USPC ..... 73/861.42, 861.65; 126/39 E, 39 R
See application file for complete search history.

(56) References Cited

U.S. PATENT DOCUMENTS

| | | | | |
|---|---|---|---|---|
| 6,318,993 | B1 | 11/2001 | Huang | |
| 7,291,009 | B2 | 11/2007 | Kamal et al. | |
| 8,845,326 | B2 | 9/2014 | Shaffer et al. | |
| 10,488,051 | B2 | 11/2019 | Moon et al. | |
| 2006/0051718 | A1* | 3/2006 | Kamal | F24C 3/085 431/278 |
| 2019/0072271 | A1 | 3/2019 | Williams | |

(Continued)

FOREIGN PATENT DOCUMENTS

| | | |
|---|---|---|
| CN | 203703975 U | 7/2014 |
| JP | 2001-56108 | 2/2001 |

(Continued)

OTHER PUBLICATIONS

PCT/ISA/210 dated Mar. 22, 2023 in International PatentApplication No. PCT/KR2022/020347.

*Primary Examiner* — Vivek K Shirsat
(74) *Attorney, Agent, or Firm* — STAAS & HALSEY LLP

(57) ABSTRACT

A gas burner device includes a burner; an injector configured to supply gas to the burner to generate a flame, the injector being on one side of the burner, the flame being generated around the burner as the gas supplied by the injector burns. The flame includes: a first flame portion farthest from an installation surface on which the gas burner device is installed, a second flame portion, and a third flame portion closest to the installation surface so that the second flame portion is between the first flame portion and the third flame portion and the second flame portion transitions the first flame portion into the third flame portion.

11 Claims, 15 Drawing Sheets

(56) References Cited

U.S. PATENT DOCUMENTS

| | | | | |
|---|---|---|---|---|
| 2019/0331337 | A1* | 10/2019 | Rasi | F24C 3/082 |
| 2020/0072462 | A1 | 3/2020 | Rasi | |
| 2021/0270458 | A1* | 9/2021 | Turchi | F24C 3/085 |

FOREIGN PATENT DOCUMENTS

| | | |
|---|---|---|
| JP | 2020-91094 | 6/2020 |
| KR | 10-2012-0067274 | 6/2012 |
| KR | 10-2017-0043756 | 4/2017 |
| KR | 10-1818822 B1 | 1/2018 |

* cited by examiner

BURNER DEVICE

CROSS-REFERENCE TO RELATED APPLICATIONS

This application a continuation application, under 35 U.S.C. § 111(a), of International Application No. PCT/KR2022/020347 designating the United States, filed on Dec. 14, 2022, and claims the priority benefit of Korean Patent Application No. 10-2022-0007935 filed on Jan. 19, 2022, in the Korean Intellectual Property Office, the disclosures of which are incorporated herein by reference in their entirety.

BACKGROUND

1. Field

Example embodiments of the following description relate to a burner device.

2. Description of the Related Art

Cooking includes raw cooking and heat cooking. A cooking appliance is a device that changes the state of food by generally heating the food. There may be various methods to generate heat for cooking. The methods may include, for example, a method using electromagnetic waves (e.g., microwaves) or a direct heating method using a heat source.

To generate heat from the heat source, some types of fuel, such as gas, oil, and coal, may be used.

A gas burner device may inject a flame using gas as fuel and cook food with heat of the flame.

For example, Korean Patent Registration No. 10-1818822 discloses an air injection type gas burner.

The above description is information the inventor(s) acquired during the course of conceiving the present disclosure, or already possessed at the time, and is not necessarily art publicly known before the present application was filed.

SUMMARY

According to an example embodiment, there is provided a gas burner device including: a burner; an injector configured to supply gas to the burner to generate a flame, the injector being on one side of the burner; the flame being generated around the burner as the gas supplied by the injector burns. The flame includes: a first flame portion farthest from an installation surface on which the gas burner device is installed; a second flame portion; and a third flame portion closest to the installation surface so that the second flame portion is between the first flame portion and the third flame portion and the second flame portion transitions the first flame portion into the third flame portion.

According to another example embodiment, there is provided a gas burner device including: a burner; and an injector configured to supply gas to generate a flame to the burner, the injector being on one side of the burner. The burner includes a stack structure formed by a first spreader and a second spreader that are sequentially stacked toward an installation surface on which the gas burner device is installed. The first spreader includes holes arranged in two layers along a circumference of the first spreader, and the second spreader includes holes arranged in one layer along a circumference of the second spreader.

According to still another example embodiment, there is provided a gas burner device including: a burner; an injector configured to supply gas to the burner to generate a flame, the injector being on one side of the burner. The flame being generated around the burner as the gas supplied by the injector burns. The burner includes a stack structure formed by a cover, a first spreader, a second spreader, and a third spreader that are sequentially stacked toward an installation surface on which the burner is installed. The first spreader includes: a first spreader body; a first gas receiving space formed inside the first spreader body; and a plurality of first flame holes arranged along a circumference of the first spreader body. The second spreader includes: a second spreader body; a second gas receiving space formed with at least a portion recessed toward the third spreader from a surface of the second spreader body facing the first spreader; a plurality of second flame holes arranged along a circumference of the second spreader body; and a plurality of third flame holes arranged to be closer to the installation surface than the second flame holes along the circumference of the second spreader body. The first spreader further includes a gas branch hole formed by penetrating through the first spreader body such that the first gas receiving space and an inside of the second spreader are connected with each other. The third spreader includes: a third spreader body; and a third gas receiving space formed with at least a portion recessed toward the installation surface from a surface of the third spreader body facing the second spreader. The second spreader further includes an auxiliary third gas receiving space formed with at least a portion recessed toward the first spreader from a surface of the second spreader body facing the third spreader, and separated from the second gas receiving space. The flame being generated includes: a first flame portion around an opposite side of the second spreader in the first spreader and through the first flame holes; a second flame portion around a position between the second spreader and the first spreader and through the second flame holes; and a third flame portion around a position between the third spreader and the second spreader and through the third flame holes. The injector includes: a first orifice configured to supply gas to the first gas receiving space; and a second orifice configured to supply gas to the third gas receiving space. The third gas receiving space may be blocked from the first gas receiving space or the second gas receiving space.

Additional embodiments will be set forth in part in the description which follows and, in part, will be apparent from the description, or may be learned by practice of the disclosure.

BRIEF DESCRIPTION OF THE DRAWINGS

These and/or other aspects will become apparent and more readily appreciated from the following description of example embodiments, taken in conjunction with the accompanying drawings of which.

DETAILED DESCRIPTION

Figure 1:
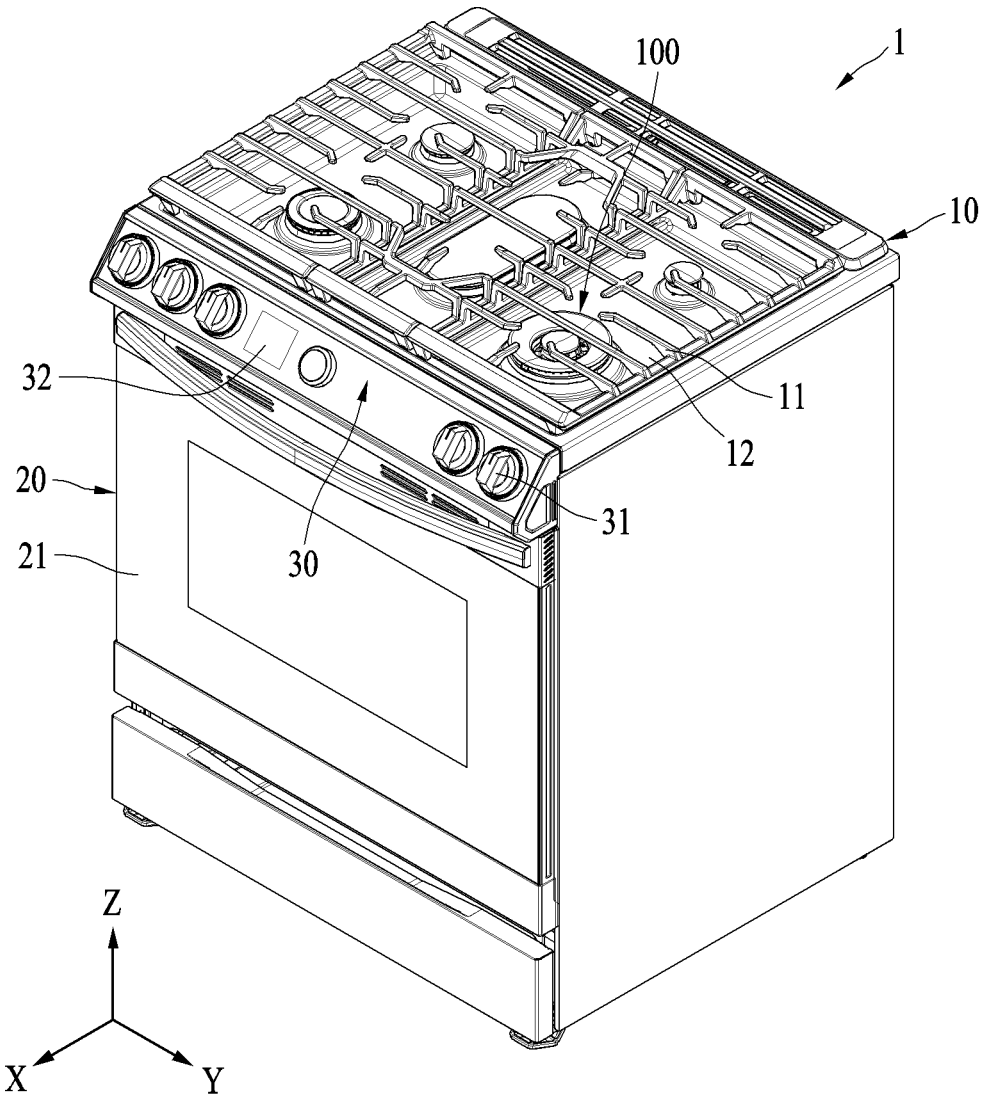
FIG. 1 is a perspective view of a cooking appliance including a burner device according to various example embodiments.

The following structural or functional descriptions of examples are merely intended for the purpose of describing the examples and the examples may be implemented in various forms. The examples are not meant to be limited, but it is intended that various modifications, equivalents, and alternatives are also covered within the scope of the claims.

Although terms of "first" or "second" are used to explain various components, the components are not limited to the terms. These terms should be used only to distinguish one component from another component. For example, a "first" component may be referred to as a "second" component, or similarly, and the "second" component may be referred to as the "first" component within the scope of the right according to the concept of the present disclosure.

Unless otherwise defined, all terms used herein including technical or scientific terms have the same meanings as those generally understood consistent with and after an understanding of the present disclosure. Terms, such as those defined in commonly used dictionaries, should be construed to have meanings matching with contextual meanings in the relevant art and the present disclosure, and are not to be construed as an ideal or excessively formal meaning unless otherwise defined herein.

Also, in the description of embodiments, detailed description of well-known related structures or functions will be omitted when it is deemed that such description will cause ambiguous interpretation of the present disclosure.

As used herein, the singular forms "a," "an," and "the" are intended to include the plural forms as well, unless the context clearly indicates otherwise. As used herein, the term "and/or" includes any one and any combination of any two or more of the associated listed items. As used herein, the terms "include," "comprise," and "have" specify the presence of stated features, numbers, operations, elements, components, and/or combinations thereof, but do not preclude the presence or addition of one or more other features, numbers, operations, elements, components, and/or combinations thereof. It will be understood that when a component is referred to as being "connected to" another component, the component can be directly connected or coupled to the other component or intervening components may be present.

Hereinafter, examples will be described in detail with reference to the accompanying drawings. When describing the examples with reference to the accompanying drawings, like reference numerals refer to like components and a repeated description related thereto will be omitted.

Among the terms used in the following description, a "first direction" refers to a +X direction represented as a coordinate axis in the accompanying drawings.

In addition, among the terms used in the following description, a "second direction" refers to a +Y direction represented as a coordinate axis in the accompanying drawings.

In addition, among the terms used in the following description, a "third direction" refers to a +Z direction represented as a coordinate axis in the accompanying drawings.

The foregoing and/or other embodiments are achieved by providing a burner device configured to readily transition a simmer flame into a main flame.

The foregoing and/or other embodiments are achieved by providing a burner device configured to prevent flame lift-off.

The foregoing and/or other embodiments are achieved by providing a burner device configured to allow gas to readily burn to prevent a main flame from lengthening.

The foregoing and/or other embodiments are achieved by providing a burner device configured to allow gas to readily burn to prevent backfire.

FIG. 1 is a perspective view of a cooking appliance 1 including a burner device 100 according to various example embodiments.

Referring to FIG. 1, the cooking appliance 1 may include an oven 20, a cooktop 10, and a panel 30 for controlling them. The cooking appliance 1 may include selectively or both the oven 20 and the cooktop 10. The cooking appliance 1 may be provided as a built-in or non-built-in type.

The oven 20 may include a door 21 provided to face the first direction and may include a cooking space (not shown) accommodating food to be cooked therein.

The cooktop 10 may be disposed in the third direction of the oven 20. The cooktop 10 may include a burner device 100, an installation surface 12 on which the burner device 100 is installed, and a grate 11 supporting a cooking tool (not shown) accommodating therein food.

The shape of the grate 11 may vary. For example, the grate 11 may be a combination of linear members having an arbitrary arrangement that allows a flame injected from the burner device 100 to effectively reach the cooking tool (not shown) supported by the grate 11. For example, the grate 11 may have a shape specified to support the cooking tool (not shown) at three points or more such that the cooking tool (not shown) is to be stably supported thereby. In addition, the cooking tool (not shown) may be provided in various sizes, and thus an arrangement method or an arrangement interval of the linear members of the grate 11 may be specified to support the cooking tool (not shown) of various sizes.

The panel 30 may be disposed on one side of the cooking appliance 1. The panel 30 may have a controller (e.g., a control valve 31) that allows a user to control the cooking appliance 1, and a display 32 transmitting information about the cooking appliance 1 to the user.

For example, on the panel 30, the control valve 31 may be disposed to control an amount of fuel supplied to the burner device 100 to control an intensity of a flame. The control valve 31 may be of various control types, such as, for example, a slide type, a rotation type, or the like. For example, the control valve 31 of the rotation type is shown in FIG. 1. The user may adjust the amount of fuel supplied to the burner device 100 by rotating the control valve 31 clockwise or counterclockwise.

The burner device 100 may generate a flame by receiving fuel and burning the fuel and may transfer heat to the cooking tool (not shown) or a cooking target to be cooked.

The burner device 100 may use various types of fuel. For example, the burner device 100 may use liquid fuel in the form of aerosol or spray, or gaseous fuel (e.g., liquefied natural gas (LNG), liquefied petroleum gas (LPG), etc.). In the following description, a case in which gas is supplied to the burner device 100 will be described as an example, but the following description may also be applied to other cases using other types of fuel.

Figure 2:
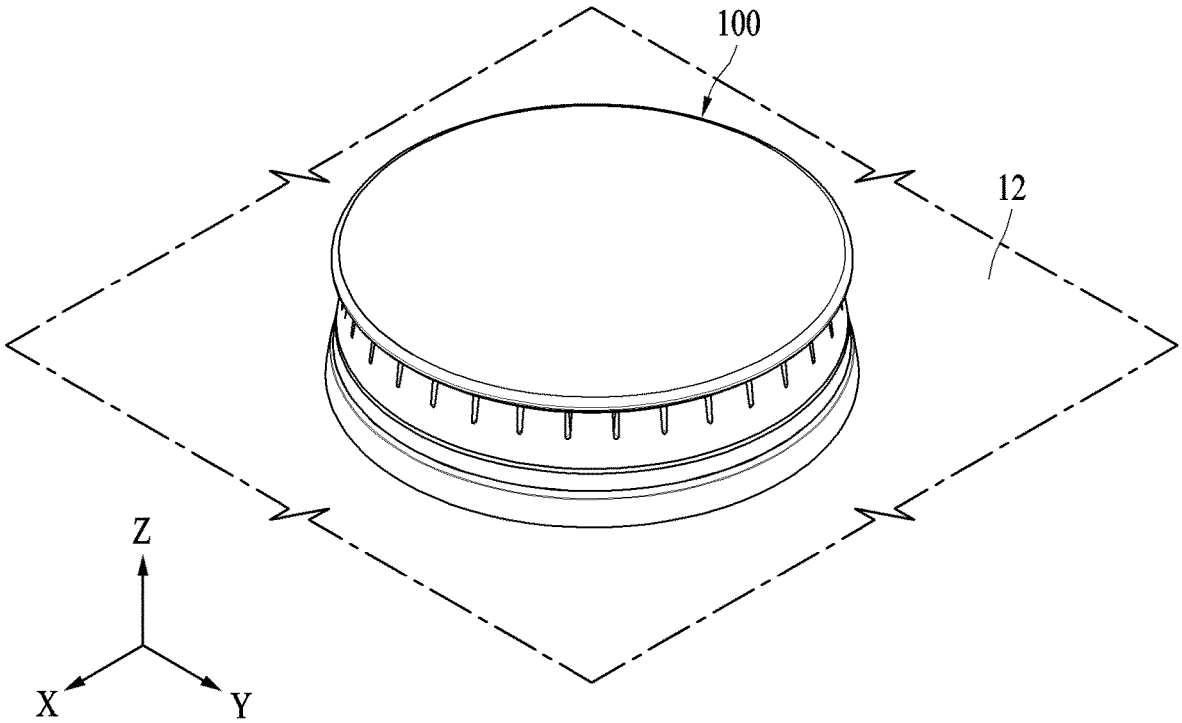
FIG. 2 is a perspective view of a burner device installed on an installation surface of a cooling appliance according to one example embodiment.
Figure 3:
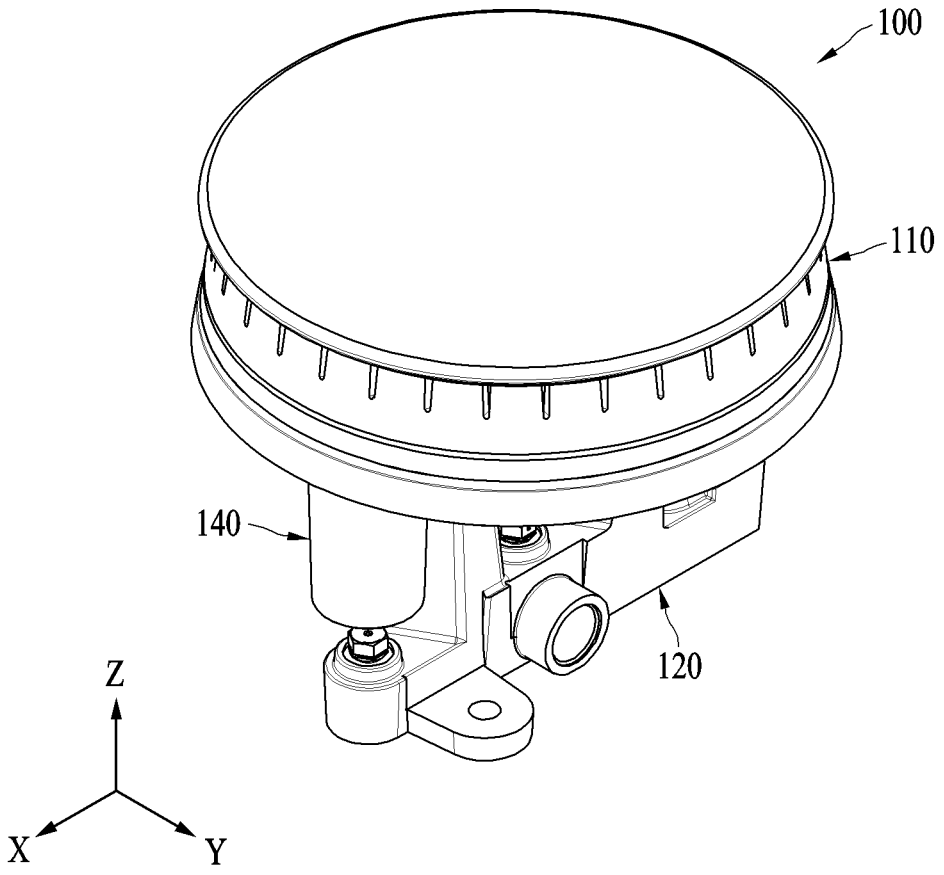
FIG. 3 is a perspective view of a burner device according to one example embodiment.
Figure 4:
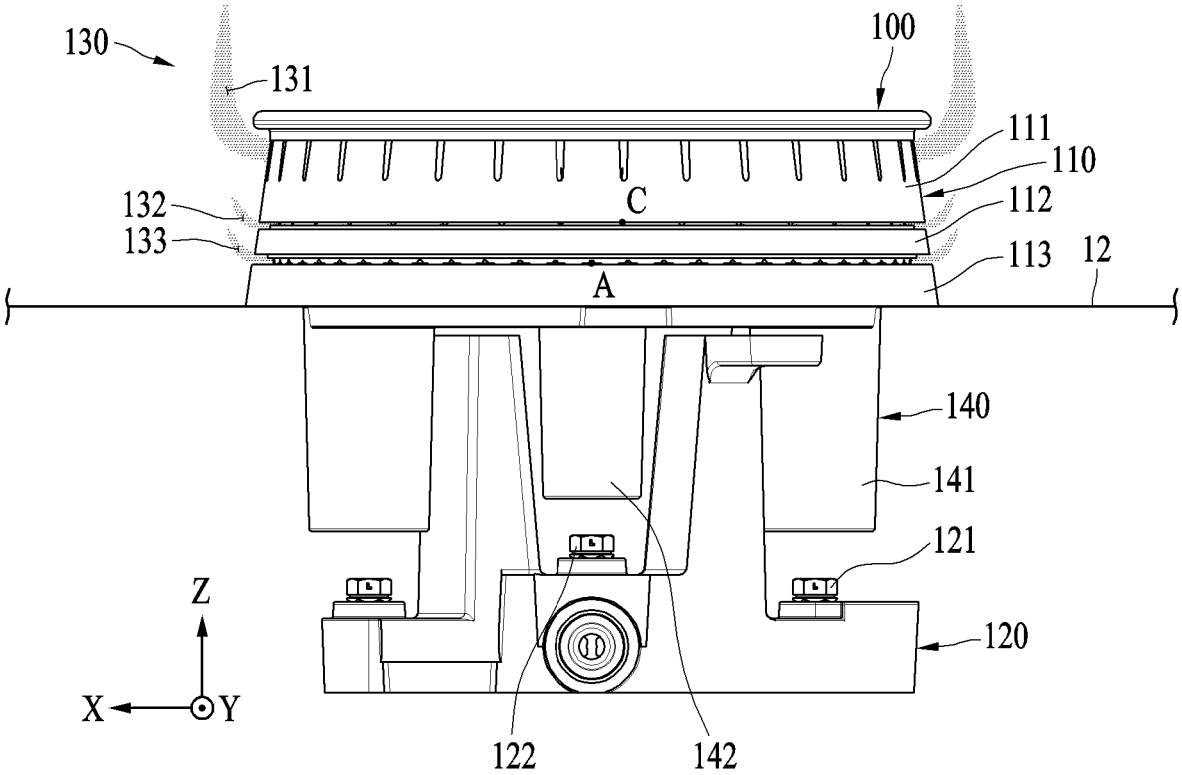
FIG. 4 is a side view of a burner device according to one example embodiment.

FIG. 2 is a perspective view of the burner device 100 installed on the installation surface 12 of the cooking appliance 1 according to one example embodiment, FIG. 3 is a perspective view of the burner device 100 according to one example embodiment, and FIG. 4 is a side view of the burner device 100 according to one example embodiment.

A portion of the grate 11 and the installation surface 12 is omitted from FIG. 2 for simplicity of description.

Referring to FIGS. 3 and 4, the burner device 100 according to one example embodiment may include a burner 110, an injector 120 supplying gas to the burner 110, a flame portion 130 generating a flame as the gas supplied from the injector 120 burns, and a venturi 140 which is a path for supplying the gas injected by the injector 120 and surrounding air to the inside of the burner 110.

Referring to FIG. 2, only a portion of the burner device 100 is exposed in the third direction of the installation surface 12, and thus the venturi 140 and the injector 120 may not be observed from the outside of a cooking appliance (e.g., the cooking appliance 1 in FIG. 1).

Referring to FIG. 4, the burner 110 and the flame portion 130 of the burner device 100 may be disposed in the third direction of the installation surface 12.

Figure 5:
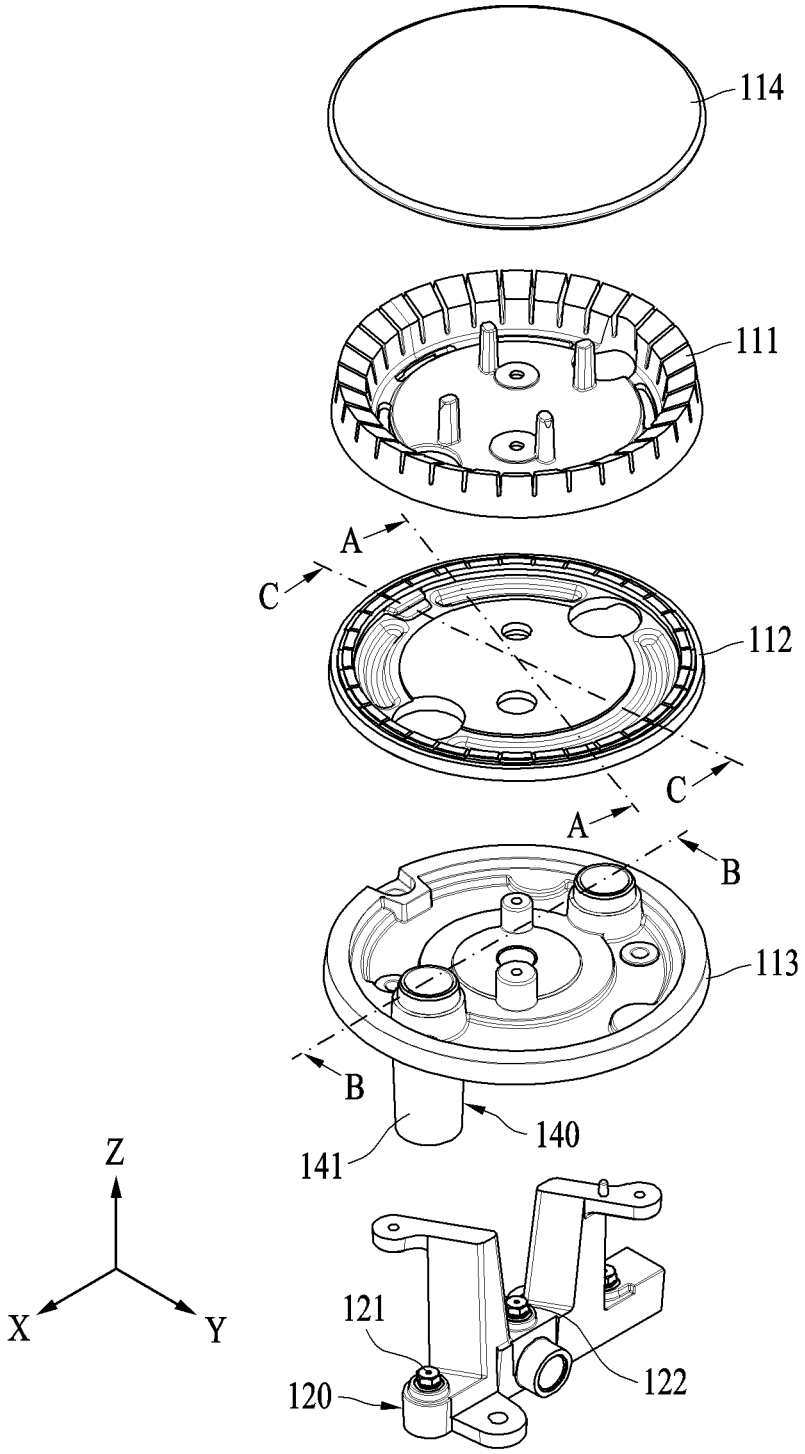
FIG. 5 is an exploded perspective view of a burner device according to one example embodiment.

FIG. 5 is an exploded perspective view of the burner device 100 according to one example embodiment.

Referring to FIGS. 4 and 5, the burner 110 may include a structure including one or more layers. For example, the burner 110 may include a stack structure in which a cover 114, a first spreader 111, a second spreader 112, and a third spreader 113 are sequentially stacked toward the installation surface 12.

In addition, the flame portion 130 may include a first flame portion 131, a second flame portion 132, and a third flame portion 133 that are disposed around the burner 110 as described above. For example, the first flame portion 131 may be disposed farthest from the installation surface 12 compared to the second flame portion 132 and the third flame portion 133, the third flame portion 133 may be disposed closest to the installation surface 12 compared to the first flame portion 131 and the second flame portion 132, and the second flame portion 132 may be disposed between the first flame portion 131 and the third flame portion 133.

For example, the first flame portion 131 may be disposed around the first spreader 111, for example, around an opposite side of the second spreader 112.

For example, the second flame portion 132 may be disposed around a position between the second spreader 112 and the first spreader 111.

For example, the third flame portion 133 may be disposed around a position between the third spreader 113 and the second spreader 112.

FIG. 4 illustrates the flame portion 130 as a shape of a flame injected from the burner 110. The flame portion 130 may have different shapes and sizes depending on an amount of gas or air supplied to the burner 110 or may vary in shape and size over time. The flame portion 130 may include all these shapes or sizes of a flame portion. In addition, the first flame portion 131, the second flame portion 132, and the third flame portion 133 may be separated from or combined with each other depending on an amount of gas or air supplied to the burner 110. The first flame portion 131, the second flame portion 132, and the third flame portion 133 may be provided as being divided to indicate relative positions with respect to the burner 110 within the single flame portion 130, and thus these divided portions may not necessarily indicate that flames or shapes need to be separated or defined. This may apply to the following description provided with reference to the accompanying drawings.

As will be described below, when gas is supplied to the burner device 100 and starts burning, fuel may be continuously supplied to the third flame portion 133 to form a flame. For example, this flame may be referred to as a simmer flame. When a control valve (e.g., the control valve 31 of FIG. 1) is adjusted, an amount of gas to be supplied to the second flame portion 132 and the first flame portion 131 may be adjusted. An intensity of the flame formed in the first flame portion 131 may vary according to the amount of gas supplied. For example, the first flame portion 131 may be referred to as a main flame. A flame formed in the second flame portion 132 may serve to transfer the flame formed in the third flame portion 133 into the first flame portion 131. For example, this may be referred to as a pilot flame. The principles, functions, and advantages of the foregoing portions will be described in detail below.

Figure 6:
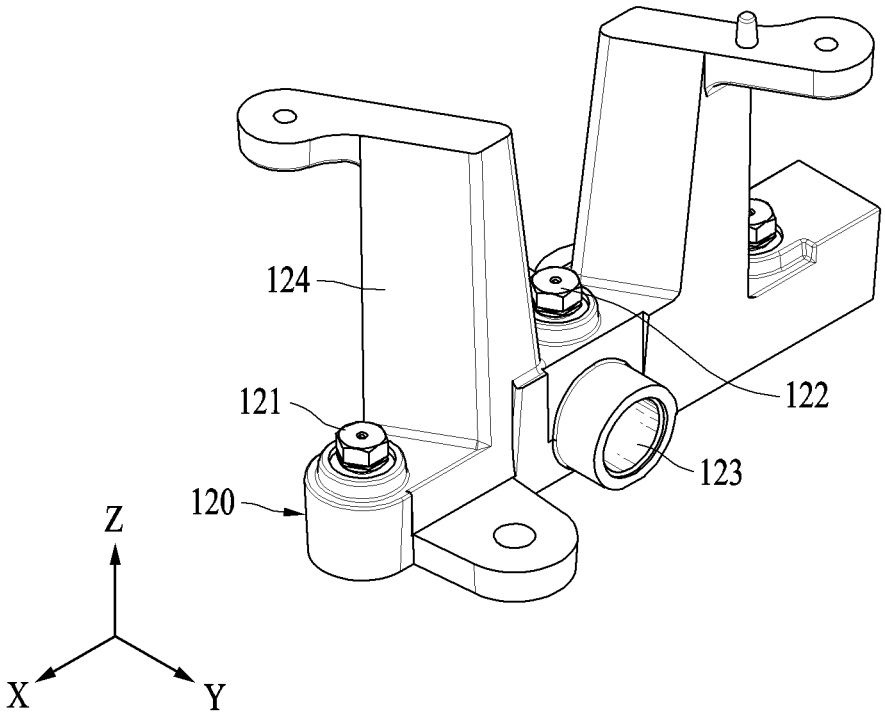
FIG. 6 is a perspective view of an injector of a burner device according to one example embodiment.

FIG. 6 is a perspective view of the injector 120 of the burner device 100 according to one example embodiment.

Referring to FIGS. 4 and 5, the injector 120 may be disposed below the burner 110.

Figure 10:
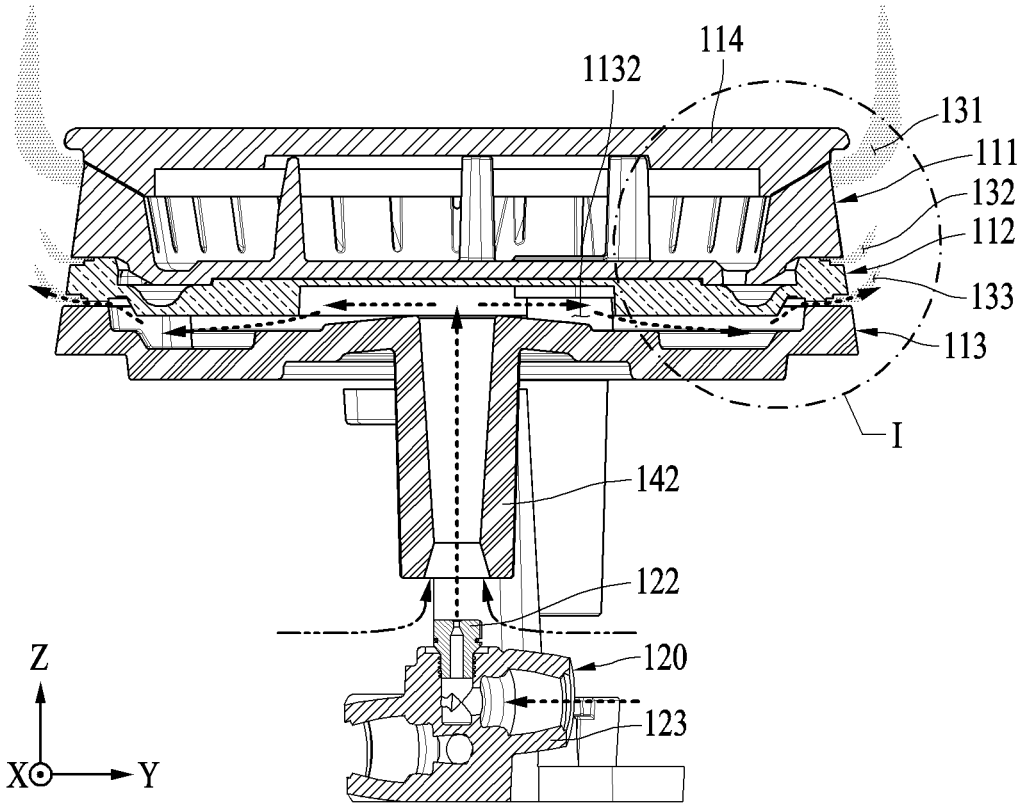
FIG. 10 is a cross-sectional view of a burner device taken along a cross-sectional line A-A shown in FIGS. 4 and 5 according to one example embodiment.

Referring to FIG. 6, the injector 120 may include an inlet 123 receiving gas supplied from outside, a burner pedestal 124 supporting a burner (e.g., the burner 110 of FIG. 4) disposed in the third direction of the injector 120, a first orifice 121 supplying gas to a main flame (e.g., the first flame portion 131 of FIG. 4) through a main venturi (e.g., a main venturi 141 of FIG. 12), and a second orifice 122 supplying gas to a simmer flame (e.g., the third flame portion 133 of FIG. 4) through a simmer venturi (e.g., a simmer venturi 142 of FIG. 10).

The inlet 123 may be provided as one or more inlets. When it is provided as a plurality of inlets 123, each of the inlets 123 may be connected to the first orifice 121 and the second orifice 122 to supply gas. For example, the inlets 123 may respectively supply gas to the main flame and the simmer flame, and respective amounts of gas injected thereto may be individually controlled.

The burner pedestal 124 may be provided in various shapes and may be formed as protruding from between the first orifice 121 and the second orifice 122 in the third direction or be formed as protruding from a circumference of the injector 120 in the third direction.

The positions of the first orifice 121 and the second orifice 122 may vary on the injector 120, and the number thereof may also vary. For example, the second orifice 122 may be disposed at a center of the injector 120, and the first orifice 121 may be disposed around the second orifice 122, and vice versa.

Figure 7:
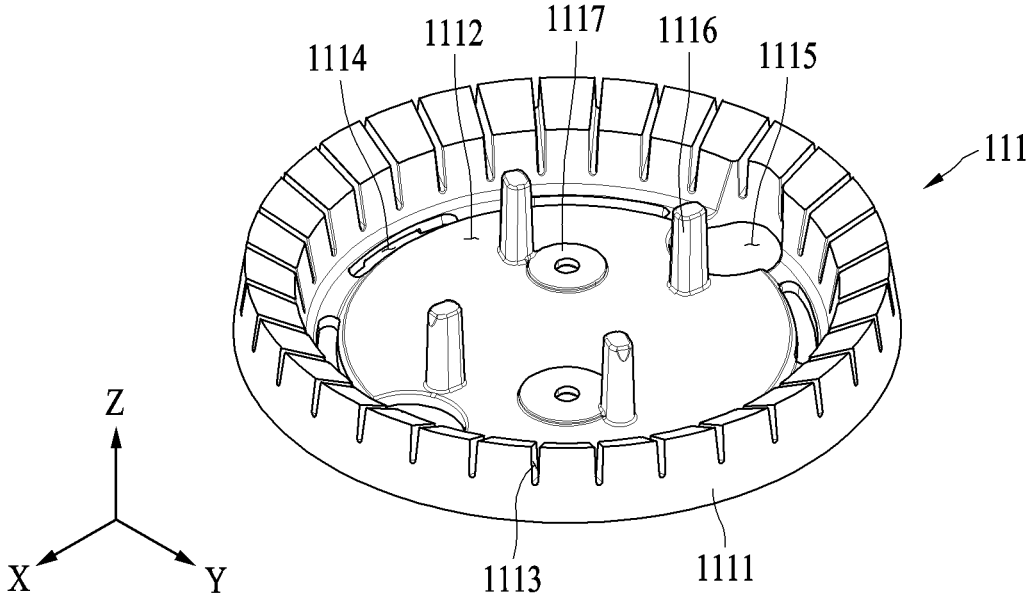
FIG. 7 is a perspective view of a first spreader of a burner device according to one example embodiment.

FIG. 7 is a perspective view of the first spreader 111 of the burner device 100 according to one example embodiment.

Referring to FIG. 7 in conjunction with FIGS. 4 and 5, the first spreader 111 may include a first spreader body 1111, a first gas receiving space 1112 formed inside the first spreader body 1111, a plurality of first flame holes 1113 arranged along a circumference of the first spreader body 1111, a cover support 1116 supporting a cover 114, a bolt seating surface 1117 for bolt coupling that maintains the stack structure by connecting the second spreader 112 and the third spreader 113, a first spreader venturi hole 1115 which is a path for receiving gas injected by the first orifice 121 through the main venturi 141, and a gas branch hole 1114 through which gas may be directed into a gas space of the second spreader 112.

The first spreader body 1111 may be provided in various shapes, for example, a rectangle, a circle, an oval, or the like. In addition, one side of the first spreader body 1111 may be opened. The open side may be covered by the cover 114, through which the first gas receiving space 1112 may be separated from the outside. By selectively exposing the first gas receiving space 1112 to the outside through the cover 114, the user may reach the inside of the first spreader 111. For example, the user may disassemble the burner device 100 by lifting the cover 114 and reaching the inside of the first spreader 111. Although not shown, the first spreader body 1111 may be formed without the one side being opened.

The first gas receiving space 1112 may be a space in which supplied gas may be accommodated. The gas in the first gas receiving space 1112 may be injected to the outside of the burner 110 through the first flame holes 1113 to burn in the first flame portion 131.

The first flame holes 1113 may be formed in various shapes and intervals by penetrating through the first spreader body 1111. For example, the first flame holes 1113 may be formed to have a greater cross-section or formed to be elongated than other flame holes of another spreader (e.g., second flame holes 1123 of FIG. 8) such that a main flame, which is the largest flame among flames generated by the burner 110, is readily formed.

Figure 9:
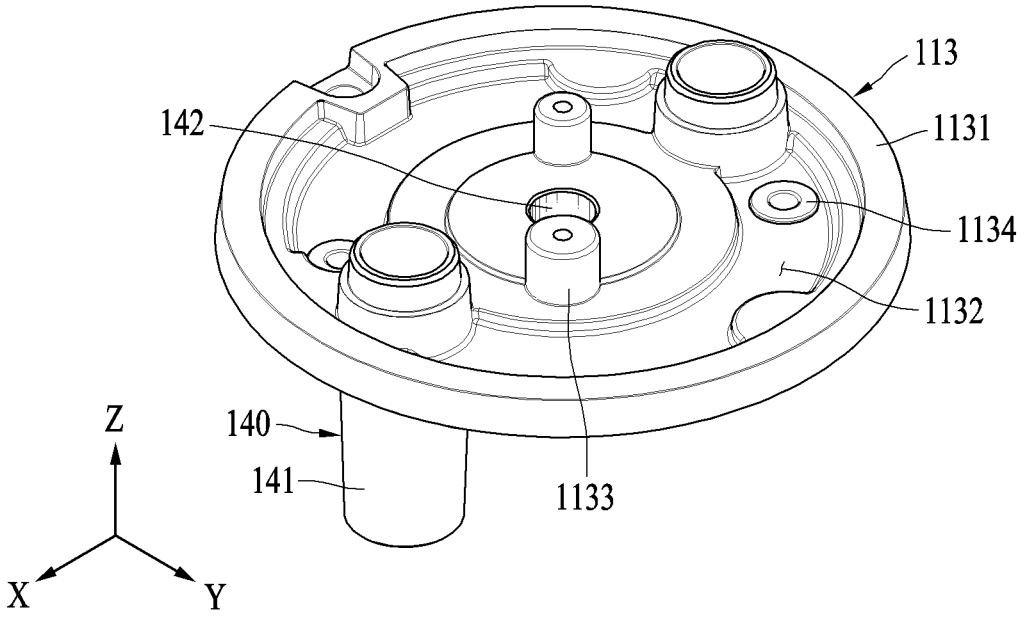
FIG. 9 is a perspective view of a third spreader and a venturi of a burner device according to one example embodiment.

The first spreader venturi hole 1115 may be connected to the main venturi 141. In relation to this, the main venturi 141 may be formed by penetrating through the third spreader 113 as shown in FIG. 9. For example, at least a portion of the main venturi 141 may penetrate through the third spreader 113 to protrude in the third direction. This protruding portion may penetrate through or be connected to the first spreader venturi hole 1115.

The gas branch hole 1114 may be formed by penetrating through the first spreader body 1111 to allow the first gas receiving space 1112 and a gas receiving space (e.g., a second gas receiving space 1122 of FIG. 8) of the second spreader 112 to communicate. For example, at least a portion of the gas branch hole 1114 may be formed along the circumference of the first spreader 111 such that gas may be entirely spread into the gas receiving space (e.g., the second gas receiving space 1122 of FIG. 8) of the second spreader 112.

Figure 8:
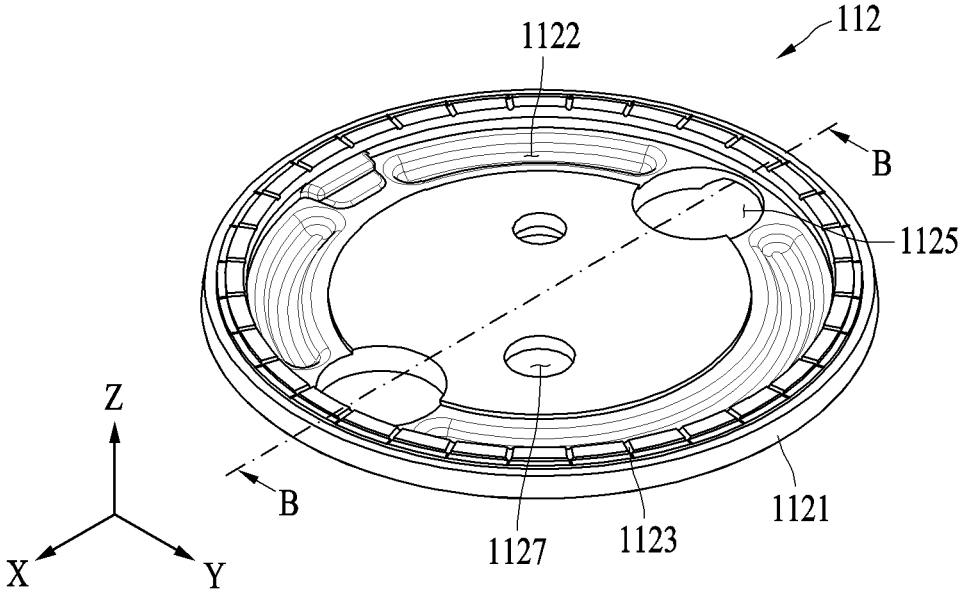
FIG. 8 is a perspective view of a second spreader of a burner device according to one example embodiment.

FIG. 8 is a perspective view of the second spreader 112 of the burner device 100 according to one example embodiment.

Referring to FIG. 8 in conjunction with FIGS. 4 and 5, the second spreader 112 may include a second spreader body 1121, a second gas receiving space 1122, a plurality of second flame holes 1123 arranged along a circumference of the second spreader body 1121, a bolt through hole 1127 through which a bolt for connecting the first spreader 111 and the third spreader 113 passes, and a second spreader venturi hole 1125 through which the main venturi 141 may penetrate. Other additional components included in the second spreader 112 will be described below.

The second spreader body 1121 may be provided in various shapes, similarly to the first spreader 111. For example, one side of the second spreader body 1121 may be opened. This open side may be covered by the first spreader 111, through which the second gas receiving space 1122 may be separated from the outside.

In the second gas receiving space 1122, gas accommodated in a first gas receiving space (e.g., the first gas receiving space 1112 of FIG. 7) may be supplied through a gas branch hole (e.g., the gas branch hole 1114 of FIG. 7). For example, the second gas receiving space 1122 may communicate with the first gas receiving space (e.g., the first gas receiving space 1112 of FIG. 7). In addition, as will be described below, the second gas receiving space 1122 may be blocked from a gas receiving space of the third spreader 113.

The second flame holes 1123 may be formed in various shapes and intervals by penetrating through the second spreader body 1121. The second gas receiving space 1122 and the second flame portion 132 may communicate with each other through the second flame holes 1123, and gas in the second gas receiving space 1122 may be injected through the second flame holes 1123 to burn in the second flame portion 132.

The second spreader venturi hole 1125 may be a hole through which the main venturi 141 penetrates. For example, unlike in a case of a first spreader venturi hole (e.g., the first spreader venturi hole 1115 of FIG. 7), the main venturi 141 may not branch out to the second spreader 112, and gas passing through the main venturi 141 may be directly supplied only to the first gas receiving space (e.g., the first gas receiving space 1112 of FIG. 7) and the second gas receiving space 1122 may receive gas only through the first gas receiving space (e.g., the first gas receiving space 1112 of FIG. 7) and the gas branch hole (e.g., the gas branch hole 1114 of FIG. 7).

FIG. 9 is a perspective view of the third spreader 113 and the venturi 140 of the burner device 100 according to one example embodiment.

Referring to FIG. 9 in conjunction with FIGS. 4 and 5, the third spreader 113 may include a third spreader body 1131, a third gas receiving space 1132, a bolt coupling hole 1133, and an injector connecting portion 1134.

The third spreader body 1131 may be provided in various shapes, similarly to the first spreader 111 and the second spreader 112. For example, one side of the third spreader body 1131 may be opened. This open side may be covered by the second spreader 112, through which the third gas receiving space 1132 may be separated from the outside.

As described above, the third gas receiving space 1132 may be blocked from a first gas receiving space (e.g., the first gas receiving space 1112 of FIG. 7) and a second gas receiving space (e.g., the second gas receiving space 1122 of FIG. 8).

In addition, for example, the venturi 140 may be formed on the third spreader body 1131. The main venturi 141 may be formed to penetrate through the third spreader body 1131, and a simmer venturi 142 may be formed to penetrate through the third spreader body 1131 or be connected to the third spreader body 1131.

The third gas receiving space 1132 may receive gas from the second orifice 122 through the simmer venturi 142.

To the bolt coupling hole 1133, a bolt (not shown) that passes through the first spreader 111 and the second spreader 112 may be coupled, and the burner 110 including the first spreader 111, the second spreader 112, and the third spreader 113 may be assembled thereby.

To the injector connecting portion 1134, a burner pedestal (e.g., the burner pedestal 124 of FIG. 6) may be coupled.

Figure 11:
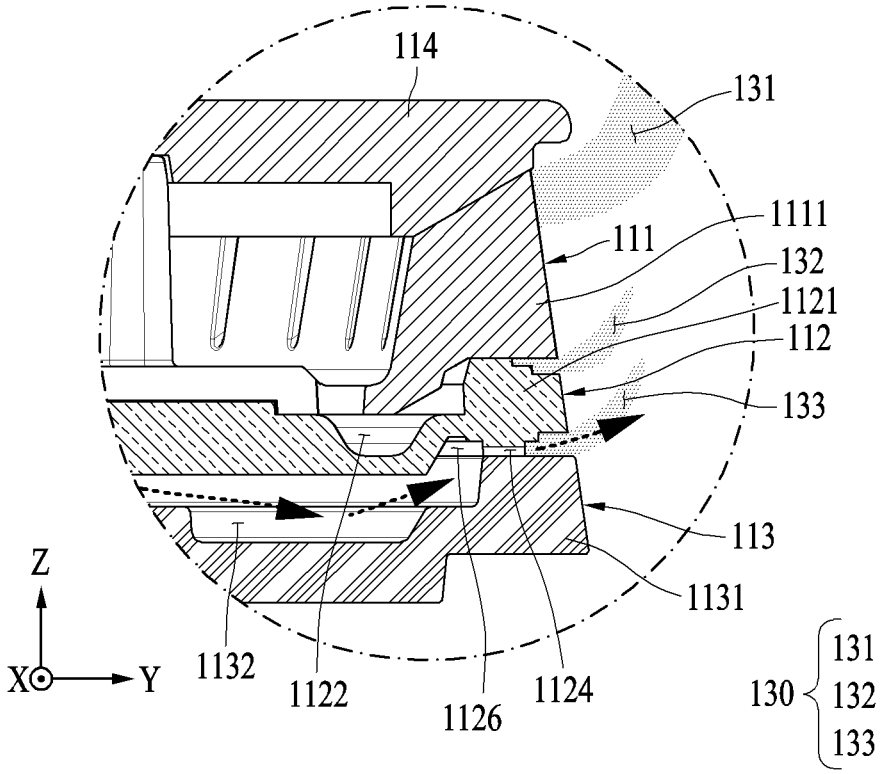
FIG. 11 is an enlarged view of part I of a burner device of FIG. 10 according to one example embodiment.

FIG. 10 is a cross-sectional view of the burner device 100 taken along a cross-sectional line A-A shown in FIGS. 4 and 5 according to one example embodiment, and FIG. 11 is an enlarged view of part I of the burner device 100 of FIG. 10 according to one example embodiment. A point through which the cross-sectional line A-A passes is illustrated in FIG. 4, which corresponds to a third flame hole 1124 illustrated in FIG. 11. A process in which gas discharged through the third flame hole 1124 burns as a simmer flame in the third flame portion 133 will be described in detail below with reference to FIGS. 10 and 11.

Referring to FIG. 11, the second spreader 112 may further include an auxiliary third gas receiving space 1126 formed as at least a portion thereof is recessed toward the first spreader 111 from a surface of the second spreader body 1121 facing the third spreader 113, and the third flame hole 1124 formed along a circumference of the second spreader body 1121.

For example, the auxiliary third gas receiving space 1126 may communicate with the third gas receiving space 1132 and communicate with the third flame hole 1124. In addition, the auxiliary third gas receiving space 1126 may be blocked from the second gas receiving space 1122 as being separated therefrom.

The third flame hole 1124 may be disposed closer to the third spreader 113 than a second flame hole 1123, and the second flame hole 1123 may be disposed closer to the first spreader 111 than the third flame hole 1124. The third flame hole 1124 may be blocked from second gas receiving space 1122 but may communicate with the third flame portion 133.

In addition, the third flame hole 1124 may be formed along a circumference of the body of the third spreader 113 rather than the body of the second spreader 112. Even in this case, the third flame hole 1124 may communicate with the third gas receiving space 1132 and the auxiliary third gas receiving space 1126 to discharge gas to the third flame portion 133.

Referring back to FIG. 10, a dotted line indicates a gas flow, and a dash-double-dotted line indicates an air flow. Hereinafter, in other accompanying drawings, a dotted line indicates a gas flow, and a dash-double-dotted line indicates an air flow.

For example, gas may be injected through the second orifice 122 past the inlet 123. The gas may be strongly injected into the simmer venturi 142 through the second orifice 122, and such a jet force may allow ambient air to be introduced into the simmer venturi 142 together with the gas. In this case, for example, adjusting a distance between the simmer venturi 142 and the second orifice 122 may control an amount of air to be continuously introduced together with the gas. This may be referred to as primary air which is to be mixed with gas to assist in the burning of the gas.

Referring to both FIGS. 10 and 11, the gas introduced into the simmer venturi 142 may enter the third gas receiving space 1132. In this case, when the auxiliary third gas receiving space 1126 is included in the second spreader 112, the gas may pass through the auxiliary third gas receiving space 1126 to be injected into the third flame portion 133 through the third flame hole 1124.

The gas injected from the third flame hole 1124 may start to burn through a spark generator (not shown), and a constant amount of gas may be continuously supplied regardless of a degree of control of a valve (e.g., the control valve 31 in FIG. 1) unless the valve is controlled to completely block the gas supply. Thus, a flame of the third flame portion 133 may be continuously maintained at a substantially constant size. The third gas receiving space 1132, the auxiliary third gas receiving space 1126, the third flame hole 1124, and the third flame portion 133 may be blocked from the second gas receiving space 1122, the first flame portion 131, and the second flame portion 132 through the inside of the burner 110, and thus the gas supplied to the third gas receiving space 1132 may be discharged to the outside of the burner 110 only through the third flame hole 1124 and may burn in the third flame portion 133.

For example, the third flame portion 133 may be a simmer flame for burning the gas discharged to the first flame portion 131 and the second flame portion 132, and thus the size of the flame of the third flame portion 133 may be maintained substantially constantly without being controlled by the valve (e.g., the control valve 31).

In addition, the flame to burn in the third flame portion 133 may burn with additional air received from around the third flame portion 133, which may be referred to as secondary air.

Figure 12:
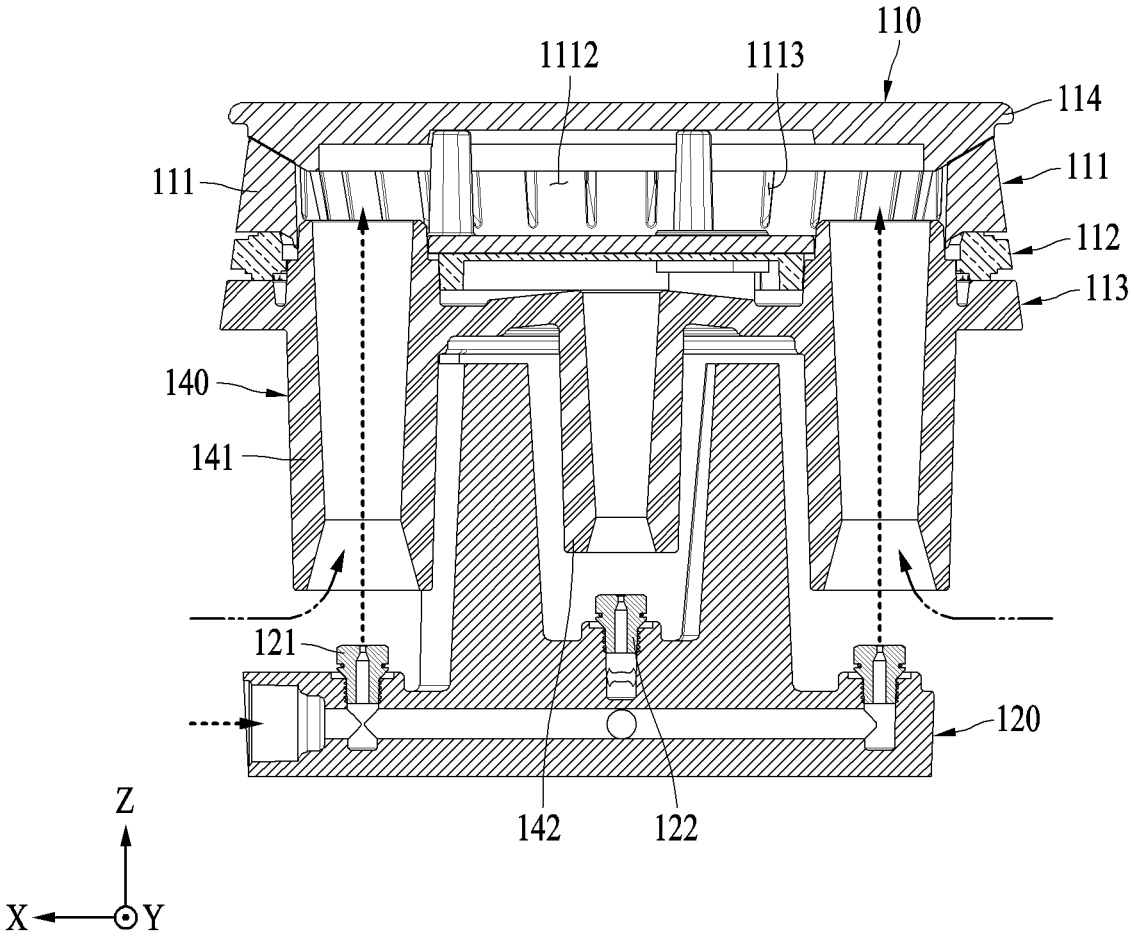
FIG. 12 is a cross-sectional view of a burner device taken along a cross-sectional line B-B shown in FIG. 5 according to one example embodiment.
Figure 13:
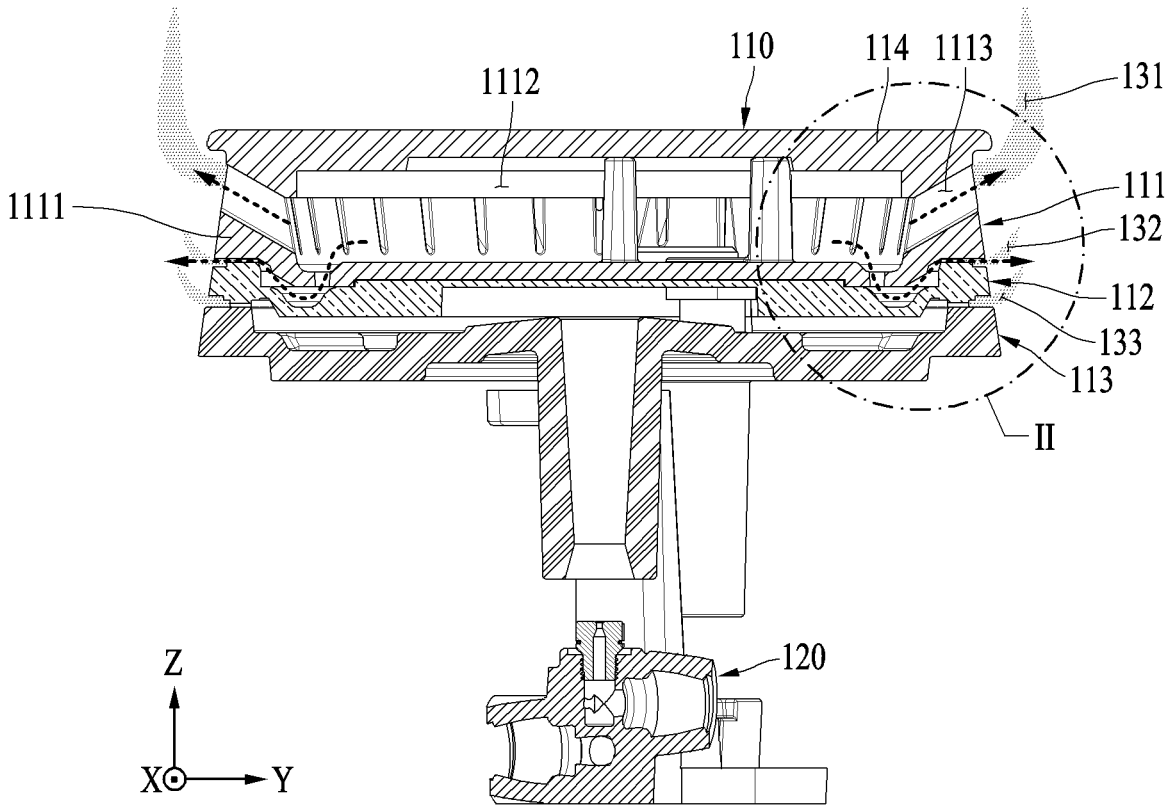
FIG. 13 is a cross-sectional view of a burner device taken along a cross-sectional line C-C shown in FIGS. 4 and 5 according to one example embodiment.
Figure 14:
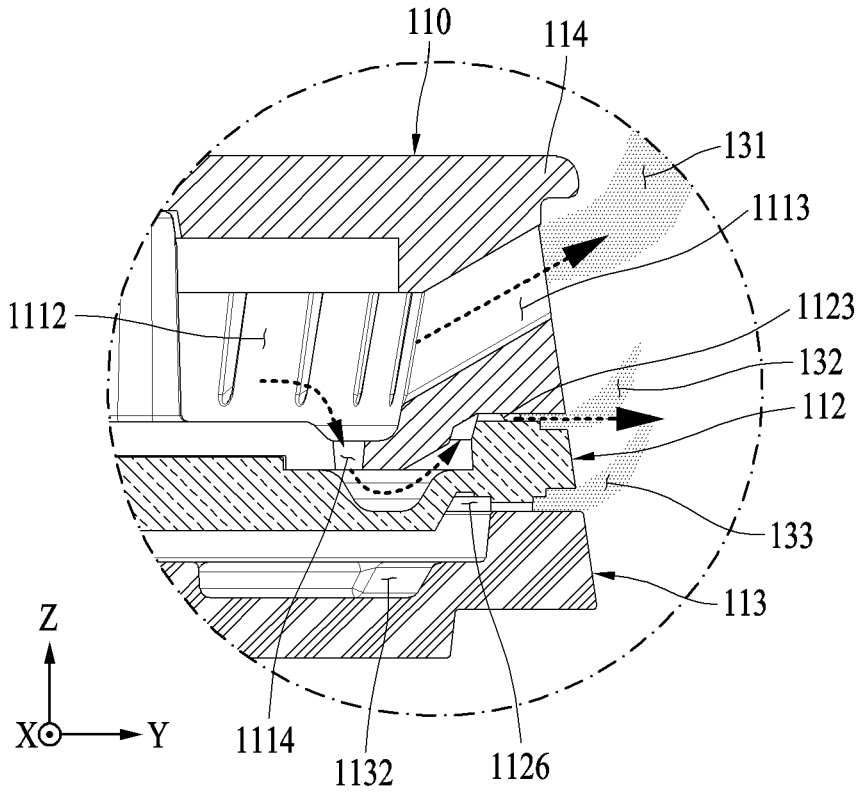
FIG. 14 is an enlarged view of part II of a burner device of FIG. 13 according to one example embodiment.

FIG. 12 is a cross-sectional view of the burner device 100 taken along a cross-sectional line B-B shown in FIG. 5 according to one example embodiment, FIG. 13 is a cross-sectional view of the burner device 100 taken along a cross-sectional line C-C shown in FIGS. 4 and 5 according to one example embodiment, and FIG. 14 is an enlarged view of part II of the burner device 100 of FIG. 13 according to one example embodiment.

Referring to FIG. 5, the cross-sectional line B-B passes through the main venturi 141. Referring to FIG. 12, gas injected into the inlet 123 may be injected through the first orifice 121 to be supplied to the inside of the main venturi 141 along with air. The foregoing description of the primary air may apply hereto.

The gas may pass through the main venturi 141 to be supplied to the first gas receiving space 1112.

Referring to FIGS. 4 and 5, the cross-sectional line C-C passes through the second flame hole 1123. Referring to FIGS. 13 and 14, gas in the first gas receiving space 1112 may be injected into the first flame portion 131 through the first flame holes 1113, and may also be injected into the second flame portion 132 through the second flame holes 1123 by passing through the gas branch hole 1114. In addition, gas supplied from the first orifice 121 to the first gas receiving space 1112 may be burned by being injected into the first flame portion 131 and the second flame portion 132.

For example, at least a portion of the second gas receiving space 1122 may be recessed on the second spreader body 1121 to be closer to the third spreader 113 than the second flame holes 1123. In this example, it may be formed to be closer to the third spreader 113 based on a line extending in a penetration direction of the second flame holes 1123.

For example, when the gas branch hole 1114 is not formed along the entire circumference of the first spreader 111 (refer to FIG. 7), gas of the second gas receiving space 1122 may be supplied preferentially only to a portion close to the gas branch hole 1114, and thus the second gas receiving space 1122 may be recessed to be lower than the second flame holes 1123 to allow the gas to be evenly spread in the second gas receiving space 1122 before being discharged into the second flame holes 1123.

Alternatively, for example, adjusting the size and spacing of the second flame holes 1123 without the recessed form of the second gas receiving space 1122 may allow the gas to be evenly spread in the second gas receiving space 1122.

Alternatively, the second gas receiving space 1122 may be manufactured regardless of the position of the second flame holes 1123 to simplify the manufacturing process.

A process of burning in the first flame portion 131 and the second flame portion 132 may be performed in a different way from a process (e.g., a process using sparks) of burning in the third flame portion 133.

For example, the second flame portion 132 may be disposed adjacent to the third flame portion 133 as described above, and thus the gas injected into the second flame portion 132 may be burned by a simmer flame generated by being burned already in the third flame portion 133. A flame may thereby be generated in the second flame portion 132. Thereafter, the flame generated in the second flame portion 132 may burn the gas injected into the first flame portion 131 disposed adjacent to the second flame portion 132, and may thereby generate a flame in the first flame portion 131 to generate a main flame. For example, the flame of the second flame portion 132 may be a pilot flame transitioning the simmer flame into the main flame as described above.

In addition, respective amounts of gas injected respectively into the first flame portion 131 and the second flame portion 132 through the first flame holes 1113 and the second flame holes 1123 after being transferred to the first gas receiving space 1112 may not be identical to each other. For example, the amount of gas injected into the second flame portion 132 may be less than the amount of gas injected into the first flame portion 131. For example, an amount of heat generated in the second flame portion 132 per unit time may be 10% or less of an amount of heat generated in the first flame portion 131 per unit time.

In addition, a ratio between a distance between a first flame hole 1113 and a second flame hole 1123 and a distance between the second flame hole 1123 and a third flame hole 1124 in the third direction may vary.

According to one example embodiment, the burner device 100 may have the following advantages with the inclusion of the second flame portion 132 that generates the pilot flame as described above.

In general, a gas burner device may generate a simmer flame by injecting a predetermined amount of gas, and generate a main flame by exposing a portion of which the amount of gas is controlled to the simmer flame, as described above. For an effective transition of the simmer flame into the main flame, the simmer flame and the main flame may need to be close to each other.

However, when the simmer flame and the main flame are too close to each other, the simmer flame and the main flame may be combined to form a flame barrier, and the secondary air around the combined flame may not be readily introduced into the inside thereof, and thus the injected gas may not be readily burned. In this case, the flame may be lengthened and may unnecessarily contact a cooking tool (not shown). In addition, the burning may not occur properly, and thus the temperature of the flame may be lowered. Also, the gas continuously injected toward the main flame may not be burned properly, and thus the gas that has not been burned may flow out of a flame portion, and the flame may be separated from flame holes accordingly. Thus, flame lift-off, a flame instability phenomenon, may thereby occur.

In contrast, when the simmer flame and the main flame are too far away from each other, the flame transition may not be performed properly. Likewise, in this case, the injected gas may not be properly burned, and thus flame lift-off may occur. In this case, backfire may also occur.

In addition, a large burner device may be required to produce a large output, and in this case, the distance between the simmer flame and the main flame may increase as needed. Also, to provide a user with the weakest degree of fire, a simmer flame having the smallest possible flame may be required.

In summary, when the distance between the simmer flame and the main flame is great for design reasons (e.g., a large burner, prevention of flame agglomeration, prevention of lifting, etc.), arranging the pilot flame between the simmer flame and the main flame may allow a flame to be generated in the main flame even with the small simmer flame.

In conclusion, according to one example embodiment, as the burner device 100 includes the second flame portion 132 disposed between the first flame portion 131 and the third flame portion 133, in addition to the first flame portion 131 and the third flame portion 133, it is possible to prevent the issues described above from arising, while readily transitioning a flame generated in the third flame portion 133 into the first flame portion 131 with the assistance of the second flame portion 132.

Thus, according to one example embodiment, it is possible to prevent such issues as flame lift-off, backfire, or the like from occurring in the burner device 100, and implement a least simmer flame while designing the burner device 100 of a large size.

Figure 15:
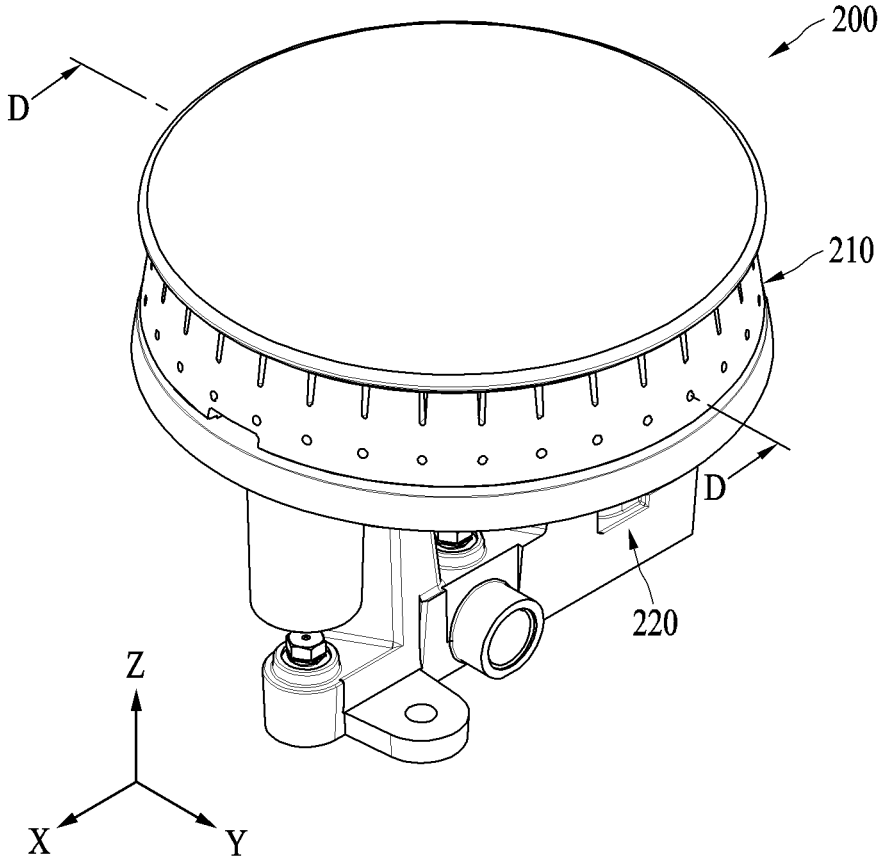
FIG. 15 is a perspective view of a burner device according to another example embodiment.
Figure 16:
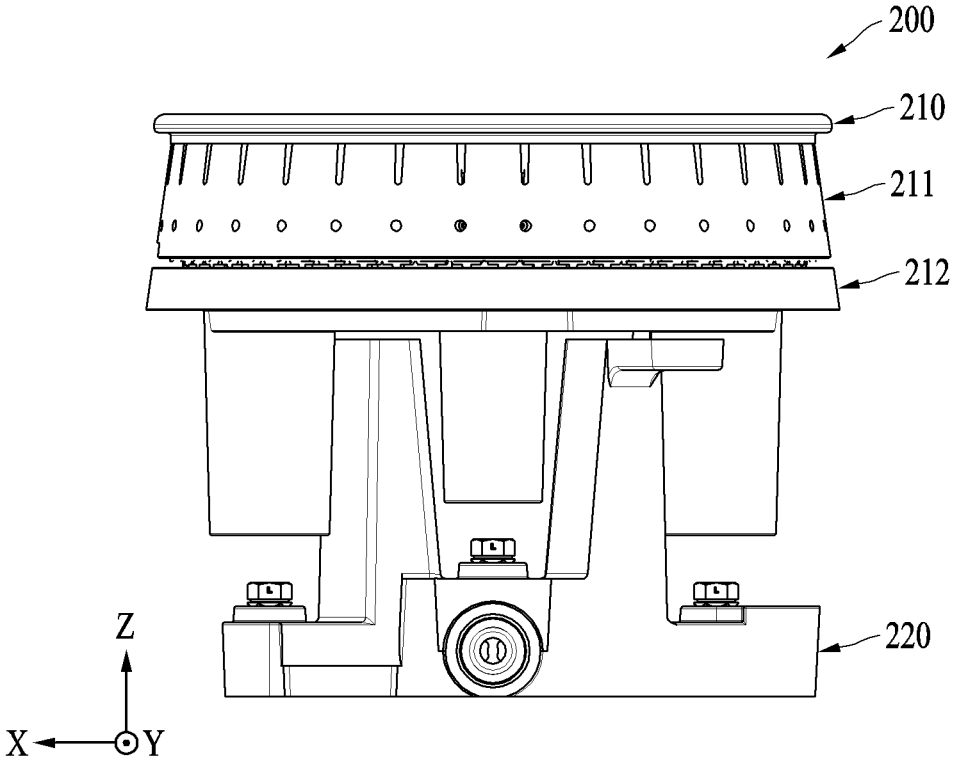
FIG. 16 is a side view of a burner device according to another example embodiment.

FIG. 15 is a perspective view of a burner device 200 according to another example embodiment, and FIG. 16 is a side view of the burner device 200 according to another example embodiment.

The burner device 200 according to another example embodiment may be different from the burner device 100 according to the example embodiment described above only in some components and may be the same or similar in other components. Hereinafter, only the different components will be described.

According to another example embodiment, a burner 210 of the burner device 200 may include a first spreader 211 and a second spreader 212 that are sequentially stacked toward an installation surface on which the burner device 200 is installed.

Figure 17:
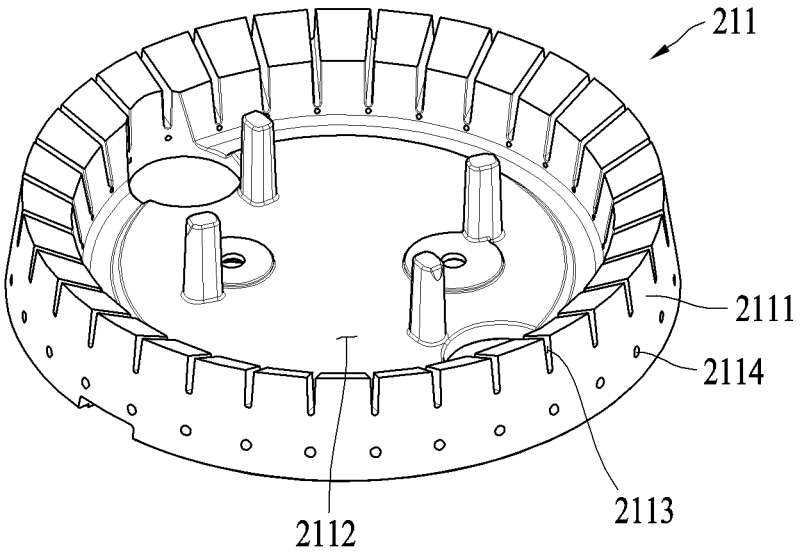
FIG. 17 is a perspective view of a first spreader of a burner device according to another example embodiment.
Figure 18:
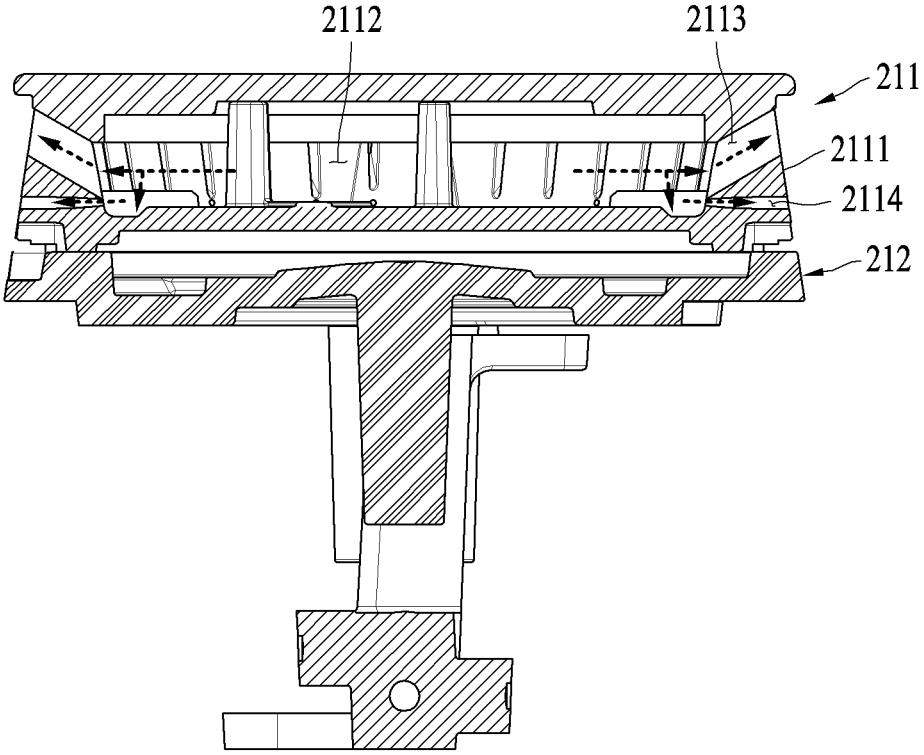
FIG. 18 is a cross-sectional view of a burner device taken along a cross-sectional line D-D shown in FIG. 15 according to another example embodiment.

FIG. 17 is a perspective view of the first spreader 211 of the burner device 200 according to another example embodiment, and FIG. 18 is a cross-sectional view of the burner device 200 taken along a cross-sectional line D-D shown in FIG. 15 according to another example embodiment.

Referring to FIG. 17, the first spreader 211 may include a first spreader body 2111, a first gas receiving space 2112 formed inside the first spreader body 2111, and holes of two layers arranged along a circumference of the first spreader body 2111.

For example, the first spreader 211 may include a plurality of first flame holes 2113 arranged along a circumference of the first spreader body 2111, and a plurality of second flame holes 2114 arranged along a circumference of the first spreader body 2111 and at the same time arranged closer to the second spreader 212 than the first flame holes 2113.

For example, the first flame holes 2113 and the second flame holes 2114 may be formed by penetrating through the first spreader body 2111 and may thus communicate with each other through the first gas receiving space 2112.

Referring to FIG. 18, gas supplied to the first gas receiving space 2112 may be discharged to the first flame holes 2113 and the second flame holes 2114 to be burned. For example, the gas injected into the second flame holes 2114 may be burned as a simmer flame is transitioned, and a flame burned around the second flame holes 2114 may burn the gas injected from the first flame hole 2113 to form a main flame.

For example, a cross-sectional area in a direction in which the first flame holes 2113 penetrates to be formed may be greater than a cross-sectional area in a direction in which the second flame holes 2114 penetrates to be formed.

According to one example embodiment, a gas burner device 100 may include: a burner 110; an injector 120 supplying gas to the burner 110 and disposed on one side of the burner 110; and a flame portion 130 disposed around the burner 110 and generating a flame as the gas burns. The flame portion 130 may include: a first flame portion 131 disposed farthest from an installation surface 12 on which the gas burner device 100 is installed; a third flame portion 133 disposed closest to the installation surface 12; and a second flame portion 132 disposed between the first flame portion 131 and the third flame portion 133 and transitioning a flame of the first flame portion 131 into the third flame portion 133.

In one example embodiment, the first flame portion 131 and the second flame portion 132 may communicate with each other, and the third flame portion 133 may be blocked from the first flame portion 131 and the second flame portion 132.

In one example embodiment, the injector 120 may include a first orifice 121 supplying gas to the first flame portion 131 and a second orifice 122 supplying gas to the third flame portion 133.

In one example embodiment, the burner 110 may include a stack structure in which a first spreader 111, a second spreader 112, and a third spreader 113 are sequentially stacked toward the installation surface 12. The third flame portion 133 may be disposed around a position between the third spreader 113 and the second spreader 112, and the second flame portion 132 may be disposed around a position between the second spreader 112 and the first spreader 111. The first flame portion 131 may be disposed around an opposite side of the second spreader 112 in the first spreader 111.

In one example embodiment, the burner 110 may further include a cover 114 stacked to cover the first spreader 111 on the opposite side of the second spreader 112 with respect to the first spreader 111.

In one example embodiment, the first spreader 111 may include: a first spreader body 1111; a first gas receiving space 1112 formed inside the first spreader body 1111; and a plurality of first flame holes 1113 arranged along a circumference the first spreader body 1111. The first flame holes 1113 may be formed by penetrating through the first spreader body 1111, and the first gas receiving space 1112 and the first flame portion 131 may communicate through the first flame holes 1113.

In one example embodiment, the second spreader 112 may include: a second spreader body 1121; a second gas receiving space 1122 formed as at least a portion of a surface of the second spreader body 1121 facing the first spreader 111 is recessed toward the third spreader 113; and a plurality of second flame holes 1123 arranged along a circumference of the second spreader body 1121. The second flame holes 1123 may be formed by penetrating through at least a portion of the second spreader body 1121 to allow the second gas receiving space 1122 and the second flame portion 132 to communicate there through.

In one example embodiment, the first spreader 111 may further include a gas branch hole 1114 that is formed by penetrating through the first spreader body 1111 to allow the first gas receiving space 1112 and the inside of the second spreader 112 to communicate with each other there through.

In one example embodiment, at least a portion of the gas branch hole 1114 may be formed along the circumference of the first spreader 111.

In one example embodiment, at least a portion of the second gas receiving space 1122 may be recessed on the second spreader body 1121 to be closer to the third spreader 113, based on a line extending in a direction in which the second flame holes 1123 penetrate to be formed.

In one example embodiment, the second spreader 112 may further include a plurality of third flame holes 1124 formed along a circumference of the second spreader body 1121, closer to the third spreader 113 than the second flame holes 1123 on the second spreader body 1121. The third flame holes 1124 may be blocked from the second gas receiving space 1122 but communicate with the third flame portion 133.

In one example embodiment, the third spreader 113 may include a plurality of third flame holes 1124 formed along a circumference of the third spreader 113, and the third flame holes 1124 may communicate with the third flame portion 133.

In one example embodiment, the third spreader 113 may include a third spreader body 1131; and a third gas receiving space 1132 formed as at least a portion thereof is recessed toward the installation surface 12 from a surface of the third spreader body 1131 facing the second spreader 112. The second spreader 112 may further include an auxiliary third gas receiving space 1126 that is formed as at least a portion thereof is recessed toward the first spreader 111 from a surface of the second spreader body 1121 facing the third spreader 113, and is separated from the second receiving space 1122. The third gas receiving space 1132 may communicate with the third flame holes 1124, and the auxiliary third gas receiving space 1126 may communicate with the third gas receiving space 1132.

In one example embodiment, the third spreader 113 may include a third spreader body 1131; and a third gas receiving space 1132 that is formed as at least a portion thereof is recessed toward the installation surface 12 from a surface of the third spreader body 1131 facing the second spreader 112. The third gas receiving space 1132 may communicate with the third flame holes 1124.

In one example embodiment, an amount of heat generated in the second flame portion 132 per unit time may be 10% or less of an amount of heat generated in the first flame portion 131 per unit time.

According to another example embodiment, a gas burner device 200 may include: a burner 210; and an injector 220 supplying gas to the burner 210 and disposed on one side of the burner 210. The burner 210 may include a stack structure in which a first spreader 211 and a second spreader 212 are sequentially stacked toward an installation surface on which the gas burner device 200 is installed, and holes may be arranged in two layers along a circumference of the first spreader 211, and holes may be arranged in one layer along a circumference of the second spreader 212.

In another example embodiment, the first spreader 211 may include: a first spreader body 1111; a first gas receiving space 2112 formed inside the first spreader body 1111; a plurality of first flame holes 2113 arranged along a circumference of the first spreader body 1111; and a plurality of second flame holes 2114 arranged closer to the second spreader 212 than the first flame holes 2113, along the circumference of the first spreader body 1111. The first flame holes 2113 and the second flame holes 2114 may be formed by penetrating through the first spreader body 1111 to communicate with the first gas receiving space 2112.

In another example embodiment, a cross-sectional area in a direction in which the first flame holes 2113 penetrate to be formed may be greater than a cross-sectional area in a direction in which the second flame holes 2114 penetrate to be formed.

In another example embodiment, an amount of heat generated around the second flame holes 2114 per unit time may be 10% or less of an amount of heat generated around the first flame holes 2113 per unit time.

According to another example embodiment, a gas burner device 100 may include: a burner 110; an injector 120 supplying gas to the burner 110 and disposed on one side of the burner 110; and a flame portion 130 disposed around the burner 110 and generating a flame as the gas burns. The burner 110 may include a stack structure in which a cover 114, a first spreader 111, a second spreader 112, and a third spreader 113 are sequentially stacked toward an installation surface 12 on which the burner 110 is installed. The first spreader 111 may include: a first spreader body 1111; a first gas receiving space 1112 formed inside the first spreader body 1111; and a plurality of first flame holes 1113 arranged along a circumference of the first spreader body 1111. The second spreader 112 may include: a second spreader body 1121; a second gas receiving space 1122 formed as at least a portion of a surface of the second spreader body 1121 facing the first spreader 111 is recessed toward the third spreader 113; a plurality of second flame holes 1123 arranged along a circumference of the second spreader body 1121; and a plurality of third flame holes 1124 arranged closer to the installation surface 12 than the second flame holes 1123, along the circumference of the second spreader body 1121. The first spreader 111 may further include a gas branch hole 1114 formed by penetrating through the first spreader body 1111 to allow the first gas receiving space 1112 and the inside of the second spreader 112 to communicate with each other there through. The third spreader 113 may include: a third spreader body 1131; and a third gas receiving space 1132 that is formed as at least a portion thereof is recessed toward the installation surface 12 from a surface of the third spreader body 1131 facing the second spreader 112. The second spreader 112 may further include an auxiliary third gas receiving space 1126 that is formed as at least a portion thereof is recessed toward the first spreader 111 from a surface of the second spreader body 1121 facing the third spreader 113, and is separated from the second gas receiving space 1122. The flame portion 130 may include: a first flame portion 131 disposed around an opposite side of the second spreader 112 in the first spreader 111 and communicating with the first flame holes 1113; a second flame portion 132 disposed around a position between the second spreader 112 and the first spreader 111 and communicating with the second flame holes 1123; and a third flame portion 133 disposed around a position between the third spreader 113 and the second spreader 112 and communicating with the third flame holes 1124. The injector 120 may include a first orifice 121 supplying gas to the first gas receiving space 1112 and a second orifice 122 supplying gas to the third gas receiving space 1132. The third gas receiving space 1132 may be blocked from the first gas receiving space 1112 or the second gas receiving space 1122.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents.

Therefore, the scope of the disclosure is defined not by the detailed description, but by the claims and their equivalents, and all variations within the scope of the claims and their equivalents are to be construed as being included in the disclosure.

What is claimed is:

1. A gas burner device, comprising:

a burner; and an injector configured to supply gas to the burner to generate a flame, the injector being on one side of the burner, the flame being generated around the burner as the gas supplied by the injector burns and the flame includes:

a first flame portion farthest from an installation surface on which the gas burner device is installed;

a second flame portion; and a third flame portion closest to the installation surface so that the second flame portion is between the first flame portion and the third flame portion and the second flame portion transitions the first flame portion into the third flame portion, wherein the first flame portion and the second flame portion are unblocked from each other, and the third flame portion is blocked from the first flame portion and the second flame portion, wherein the burner comprises:

a stack structure formed by a first spreader, a second spreader, and a third spreader that are sequentially stacked toward the installation surface, wherein:

the third flame portion is around a position between the third spreader and the second spreader, the second flame portion is around a position between the second spreader and the first spreader, and the first flame portion is around an opposite side of the second spreader in the first spreader, wherein the first spreader comprises:

a first spreader body;

a first gas receiving space formed inside the first spreader body; and a plurality of first flame holes arranged along a circumference of the first spreader body, wherein the plurality of first flame holes are formed by penetrating through the first spreader body, such that the first gas receiving space and the first flame portion are unblocked from each other, wherein the first spreader further comprises:

a gas branch hole formed by penetrating through the first spreader body such that the first gas receiving space and inside of the second spreader are unblocked from each other.

2. The gas burner device of claim 1, wherein the injector comprises:

a first orifice configured to supply gas to the first flame portion; and a second orifice configured to supply gas to the third flame portion.

3. The gas burner device of claim 1, further comprising:

a cover configured to be stacked to cover the first spreader from the opposite side of the second spreader with respect to the first spreader.

4. The gas burner device of claim 1, wherein the second spreader comprises:

a second spreader body;

a second gas receiving space formed as at least a portion of a surface of the second spreader body facing the first spreader and recessed toward the third spreader; and a plurality of second flame holes arranged along a circumference of the second spreader body, wherein the plurality of second flame holes are formed by penetrating through at least a portion of the second spreader body, such that the second gas receiving space and the second flame portion are unblocked from each other.

5. The gas burner device of claim 1, wherein at least a portion of the gas branch hole is formed along the circumference of the first spreader body.

6. The gas burner device of claim 4, wherein the at least a portion of the second gas receiving space is formed to be recessed on the second spreader body to be closer to the third spreader with respect to a line extending along a direction in which the plurality of second flame holes penetrate.

7. The gas burner device of claim 6, wherein the second spreader further comprises:

a plurality of third flame holes formed along the circumference of the second spreader body are closer to the third spreader than the plurality of second flame holes on the second spreader body, wherein the plurality of third flame holes are blocked from the second gas receiving space, and the plurality of third flame holes are unblocked from the third flame portion.

8. The gas burner device of claim 6, wherein the third spreader comprises:

a plurality of third flame holes formed along a circumference of the third spreader, wherein the plurality of third flame holes are unblocked from the third flame portion.

9. The gas burner device of claim 7, wherein the third spreader comprises:

a third spreader body; and a third gas receiving space formed with at least a portion recessed toward the installation surface from a surface of the third spreader body facing the second spreader, wherein the second spreader further includes:

an auxiliary third gas receiving space formed with at least a portion recessed toward the first spreader from a surface of the second spreader body facing the third spreader, and separated from the second gas receiving space, wherein the third gas receiving space connects with the plurality of third flame holes, and the auxiliary third gas receiving space connects with the third gas receiving space.

10. The gas burner device of claim 8, wherein the third spreader comprises:

a third spreader body; and a third gas receiving space formed with at least a portion recessed toward the installation surface from a surface of the third spreader body facing the second spreader, wherein the third gas receiving space connects with the plurality of third flame holes.

11. The gas burner device of claim 1, wherein an amount of heat generated in the second flame portion per unit time is less than or equal to 10% of an amount of heat generated in the first flame portion per unit time.

* * * * *